US008555902B2

(12) United States Patent
Boehm et al.

(10) Patent No.: US 8,555,902 B2
(45) Date of Patent: Oct. 15, 2013

(54) HIGH-PRESSURE CLEANING APPLIANCE WITH MOVABLE CHANNEL CONSTRICTION SECTION

(75) Inventors: Michael Boehm, Sulzbach (DE); Peter Pfaff, Aichwald (DE); Werner Schwab, Rudersberg (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/434,963

(22) Filed: Mar. 30, 2012

(65) Prior Publication Data

US 2012/0234365 A1 Sep. 20, 2012

Related U.S. Application Data

(63) Continuation of application No. PCT/EP2010/061378, filed on Aug. 5, 2010.

(30) Foreign Application Priority Data

Oct. 14, 2009 (DE) ..... 20 2009 014 093 U

(51) Int. Cl.
*B08B 3/00* (2006.01)

(52) U.S. Cl.
USPC ..... 134/105; 134/106

(58) Field of Classification Search
USPC ..... 134/105, 106
See application file for complete search history.

(56) References Cited

U.S. PATENT DOCUMENTS 4,292,933 A * 10/1981 Meier et al. ..... 122/114
6,887,073 B1 5/2005 Ruffolo
2009/0197521 A1* 8/2009 Perrin ..... 454/369
2010/0083883 A1* 4/2010 Hofer et al. ..... 110/234
2011/0044808 A1* 2/2011 Claussen et al. ..... 415/206

FOREIGN PATENT DOCUMENTS

| | | | |
|---|---|---|---|
| DE | 919 188 | | 10/1954 |
| DE | 3617556 | A * | 12/1987 |
| DE | 4209267 | C1 * | 2/1993 |
| EP | 1 491 129 | | 12/2004 |
| GB | 206 544 | | 11/1923 |
| WO | WO 2008083787 | A1 * | 7/2008 |

OTHER PUBLICATIONS

*Patent Abstracts of Japan*, Abstract of Japanese Patent "Burner Device", Publication No. 56162311, Dec. 14, 1981, Japanese Application No. 55065438, May 19, 1980.

* cited by examiner

*Primary Examiner* — Joseph L Perrin
*Assistant Examiner* — Charles W Kling
(74) *Attorney, Agent, or Firm* — Lipsitz & McAllister, LLC

(57) ABSTRACT

The invention relates to a high-pressure cleaning appliance, comprising a heatable heat exchanger for heating up a liquid dispensable by the high-pressure cleaning appliance, a blower with a flow channel connected thereto for supplying combustion air to the heat exchanger, and a setting member for setting the amount of combustion air suppliable to the heat exchanger, the setting member having a channel constriction section which is positionable in the flow channel and movable relative thereto for changing the free cross-sectional area of the flow channel. In order to develop a generic high-pressure cleaning appliance further so that the amount of combustion air suppliable to the heat exchanger can be better adjusted, it is proposed that the channel constriction section be configured so as to be slidingly displaceable relative to the flow channel.

25 Claims, 5 Drawing Sheets

HIGH-PRESSURE CLEANING APPLIANCE WITH MOVABLE CHANNEL CONSTRICTION SECTION

This application is a continuation of international application number PCT/EP2010/061378 filed on Aug. 5, 2010 and claims the benefit of German application number 20 2009 014 093.8 filed on Oct. 14, 2009.

The present disclosure relates to the subject matter disclosed in international application number PCT/EP2010/061378 of Aug. 5, 2010 and German application number 20 2009 014 093.8 of Oct. 14, 2009, which are incorporated herein by reference in their entirety and for all purposes.

BACKGROUND OF THE INVENTION

The invention relates to a high-pressure cleaning appliance, comprising a heatable heat exchanger for heating up a liquid dispensable by the high-pressure cleaning appliance, a blower with a flow channel connected thereto for supplying combustion air to the heat exchanger, and a setting member for setting the amount of combustion air suppliable to the heat exchanger, the setting member having a channel constriction section which is positionable in the flow channel and movable relative thereto for changing the free cross-sectional area of the flow channel.

Such high-pressure cleaning appliances are known, in which the setting member comprises, in each case, a throttle flap with a channel constriction section rotatable relative to the flow channel. The free cross-sectional area of the flow channel differs in accordance with the angular position of the channel constriction section relative to the flow channel, so that the amount of combustion air supplied to the heat exchanger can thereby be set. "The amount of combustion air supplied to the heat exchanger" is, in this case, to be understood as considered per time unit and, therefore, designates the volume flow rate of combustion air.

High-pressure cleaning appliances equipped with throttle flaps have been found to work well in practice. Even better adjustability of the amount of combustion air that is to be supplied to the heat exchanger would, however, be desirable.

The object of the present invention is to so develop a generic high-pressure cleaning appliance that the amount of combustion air suppliable to the heat exchanger can be better adjusted.

SUMMARY OF THE INVENTION

This object is accomplished, in accordance with the invention, in a high-pressure cleaning appliance of the kind mentioned at the outset in that the channel constriction section is configured so as to be slidingly displaceable relative to the flow channel.

A sliding displacement of the channel constriction section relative to the flow channel in the high-pressure cleaning appliance in accordance with the invention can effect a change in the free cross-sectional area of the flow channel, which is linearly dependent upon the path of displacement of the channel constriction section relative to the flow channel. This is not possible with high-pressure cleaning appliances with a channel constriction section rotatable relative to the flow channel that are known from the prior art. There the change in the free cross-sectional area occurs in dependence upon the change in the angle between the channel constriction section and the flow channel. In particular, the change in the free cross-sectional area does not depend linearly on the change in the angle. Owing to the linear dependence of the change in the free cross-sectional area on the path of displacement of the channel constriction section in the high-pressure cleaning appliance in accordance with the invention, the change in the amount and, therefore, also the total amount of combustion air supplied to the heat exchanger can, in practice, be set more precisely.

In addition, the displaceable configuration of the channel constriction section relative to the flow channel allows a constructional simplification of the setting member.

It may be provided that the setting member in its entirety is configured as displaceable relative to the flow channel.

It is advantageous for the channel constriction section to be displaceable transversely to the direction of flow of the combustion air in the flow channel as the space required for installation of the setting member and, in particular, of the channel constriction section can thereby be reduced. It is possible to minimize the installation space especially in the case of a channel constriction section that is displaceable perpendicularly to the direction of flow of the combustion air.

To enable the amount of combustion air suppliable to the heat exchanger to be set more precisely, it is advantageous for the channel constriction section, and, in particular, even more advantageous for the setting member, to be displaceable in a stepless manner relative to the flow channel, for, in this way, the free cross-sectional area of the flow channel can be changed in a stepless manner.

The channel constriction section is preferably positionable in at least one direction oriented transversely and, in particular, perpendicularly to the direction of displacement in a manner free of play in the flow channel. In this way, the direction of displacement of the channel constriction section can be clearly defined. In particular, a guide can be formed for the channel constriction section, with, for example, the latter lying against the inside of a wall of the flow channel during the displacement.

The high-pressure cleaning appliance advantageously comprises at least one stop element for delimiting the path of displacement of the channel constriction section, so that the latter can assume at least one and preferably two definable end positions relative to the flow channel. In one end position, it may, for example, be provided that the free cross-sectional area of the flow channel is minimized, but the latter is not completely closed by the channel constriction section so as not to entirely block the supply of combustion air to the heat exchanger. It may also be provided that in one end position, the channel constriction section does not fully release the entire cross-sectional area of the flow channel.

It has already been mentioned that the channel constriction section can be guided relative to the flow channel. In particular, the high-pressure cleaning appliance comprises a guide device for guiding the channel constriction section relative to the flow channel. Consequently, a user can easily displace the channel constriction section relative to the flow channel without having to pay attention to the direction of displacement.

It is advantageous for the guide device to comprise at least one contact element against which the setting member is positionable, during the displacement, with a guide section coupled to the channel constriction section. The at least one contact element is, for example, a rib or bar extending longitudinally in the direction of displacement, against which the guide section lies slidingly during the displacement. The at least one contact element may be designed in such a way that the guide section can be supported thereon in two directions oriented transversely and, in particular, perpendicularly to the direction of displacement.

It may be provided that the channel constriction section comprises and/or forms the guide section.

The guide device preferably comprises an elongate hole extending along the direction of displacement of the channel constriction section and a guide element engaging the elongate hole. In this way, it is possible to form a constructionally simple guide in which the guide element, for example, a guide pin, can engage the elongate hole transversely to the direction of displacement in a manner free of play.

To achieve a simple construction for the guide device, it is advantageous for the guide section to comprise the elongate hole.

A simple construction of the guide device is further promoted by the guide device being at least partially connected in one piece to the flow channel. It may thus be provided that the aforementioned at least one stop element is connected in one piece to the flow channel and, for example, is made together with the latter from a one-piece plastic molded part.

The high-pressure cleaning appliance advantageously comprises a locking device for releasably locking the channel constriction section relative to the flow channel. When the channel constriction section is locked relative to the flow channel, it can, in this way, be ensured that the free cross-sectional area of the latter will not change. The amount of combustion air suppliable to the heat exchanger then no longer changes either. In this way, a constant operation of the high-pressure cleaning appliance can be ensured.

It is advantageous for the locking device to be configured as a clamping device. It has been shown that a simple construction and a compact design of the locking device can thereby be achieved.

Alternatively or additionally, the locking device may be configured as a latching device.

The locking device preferably comprises an elongate hole extending along the direction of displacement of the channel constriction section, and a first fixing element passing through the elongate hole, and a second fixing element which interacts with the first fixing element to fix the elongate hole relative to the first and second fixing elements. This makes it possible to impart a simple construction to the locking device. The elongate hole, which may be the aforementioned elongate hole of the guide device, can be fixed by means of and relative to two interacting fixing elements. The fixing elements are, for example, a screw element and a nut element corresponding thereto. This also makes it possible to form the locking device as a clamping device.

To achieve a simple construction of the locking device, it is advantageous for the setting member to comprise a fixing section which includes the elongate hole and is coupled to the channel constriction section. The fixing section may be the aforementioned guide section of the guide device.

It may be provided that the channel constriction section comprises and/or forms the guide section.

It is advantageous for the locking device to be at least partially connected in one piece to the flow channel, for example, in the form of a one-piece plastic molded part. A simple construction is thereby obtained for the locking device.

It is advantageous for the locking device to be arranged outside of the flow channel, as this facilitates its handling by a user. The channel constriction section can be locked relative to the flow channel without the flow channel having to be opened for this.

The high-pressure cleaning appliance preferably comprises a setting device for displacing the channel constriction section. The channel constriction section and, particularly preferred, the setting member, can be displaced in a more user-friendly manner relative to the flow channel by the setting device.

It is advantageous for the setting device to have a setting section coupled to the channel constriction section with at least one setting element having a contact surface oriented transversely to the direction of displacement of the channel constriction section. A user can act upon the contact surface of the at least one setting element with a force oriented in the direction of displacement in order to displace the channel constriction section. The at least one setting element can have a contact surface for displacement of the channel constriction section in a first direction and a further contact surface for displacement of the channel constriction section in the second direction opposite thereto. The setting section may be the aforementioned guide section and/or the aforementioned fixing section.

It may be provided that the channel constriction section comprises and/or forms the setting section.

The setting section advantageously comprises a plurality of setting elements which are spaced from one another along the direction of displacement of the channel constriction section. This makes it possible for a user to act upon a plurality of setting elements with an adjusting force in order to displace the channel constriction section. This facilitates handling of the setting member by a user. The plurality of setting elements are, in particular, of identical configuration and/or equidistantly spaced from one another.

The plurality of setting elements preferably form together with a setting tool allocatable to the setting member a linear drive. This allows particularly user-friendly displacement of the channel constriction section. For example, by way of arrangement of their contact surfaces in a row, the setting elements form a toothed or wave-shaped profile on which the setting tool can roll with a contact surface formed so as to correspond thereto. In this way, the setting section and together with it the channel constriction section can be displaced relative to the flow channel.

In a simple constructional design of the setting device, the setting section comprises an elongate hole, on one of the rims of which the plurality of setting elements are arranged. The elongate hole may be the aforementioned elongate hole of the guide device and/or the aforementioned elongate hole of the locking device. The setting elements may, for example, be formed as projections, such as teeth or the like, on a rim of the elongate hole.

It is advantageous for the high-pressure cleaning appliance to comprise a display device for displaying the position of the channel constriction section relative to the flow channel. This makes it easy for a user to recognize which position the channel constriction section is assuming relative to the flow channel, and so the size of its free cross-sectional area is easy to determine.

The setting member is preferably at least partially of plate-shaped configuration, so that a simple constructional design is imparted to it. It also has a low space requirement and can be produced cost-effectively.

For the same reasons, the channel constriction section is advantageously of plate-shaped configuration, for example, in the form of a plate which is displaceable relative to the flow channel and engages therein. The plate can lie slidingly against the inner sides of walls of the flow channel during the displacement, so that the channel constriction section is arranged transversely to the direction of displacement in a manner free of play in the flow channel and is guided relative thereto.

To achieve a simple construction and cost-effective production of the setting member, it is also advantageous for the setting member to comprise a plate-shaped guide section for guiding the channel constriction section and/or a plate-shaped fixing section for releasably locking the channel constriction section and/or a plate-shaped setting section for displacing the channel constriction section.

It is particularly advantageous for the setting member in its entirety to be of plate-shaped configuration.

The setting member is preferably of one piece configuration and/or is advantageously made of metal because both a simple constructional design and a cost-effective production of the setting member are thereby achievable.

A different type of embodiment of the high-pressure cleaning appliance in accordance with the invention comprises a setting member made of plastic material.

It is advantageous for the channel constriction section to pass through a through-opening formed in a wall of the flow channel. This makes it possible for the channel constriction section to engage in the flow channel so that when the channel constriction section is displaced relative to the flow channel, its free cross-sectional area can be changed.

It is advantageous for the through-opening to be of slit-shaped configuration, with the channel constriction section advantageously being of plate-shaped configuration.

The following description of a preferred embodiment of the invention serves to explain the invention in greater detail in conjunction with the drawings.

DETAILED DESCRIPTION OF THE INVENTION

Figure 1:
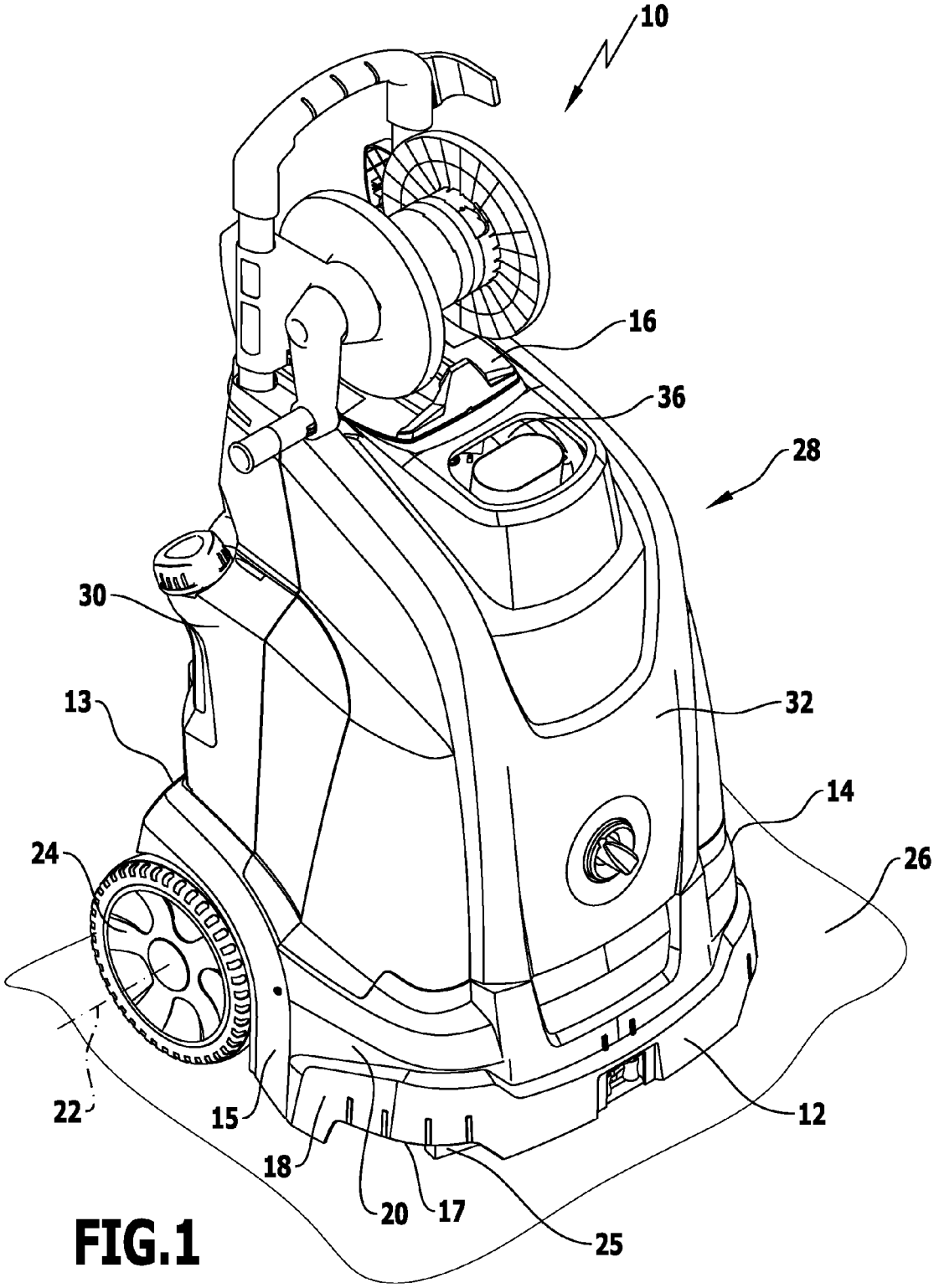
FIG. 1 shows a perspective view of a high-pressure cleaning appliance in accordance with the invention with a housing comprising a hood.

A preferred embodiment of a high-pressure cleaning appliance in accordance with the invention is shown in perspective in FIG. 1 and designated in its entirety by reference numeral 10 therein. It comprises a front side 12, a rear side 13, a left side 14, a right side 15, an upper side 16 and an underside 17.

The high-pressure cleaning appliance 10 comprises a bottom part 18 with a chassis 20 on which two wheels rotatable about a common axis of rotation 22 are held near the rear side 13. Only one wheel 24 of these is shown in the drawings. The high-pressure cleaning appliance 10 can stand on a set-down surface 26 with the wheel 24 and the wheel that is not shown and with a plurality of support elements formed on the underside 17 of the chassis 20, only one support foot 25 of which is shown.

Figure 2:
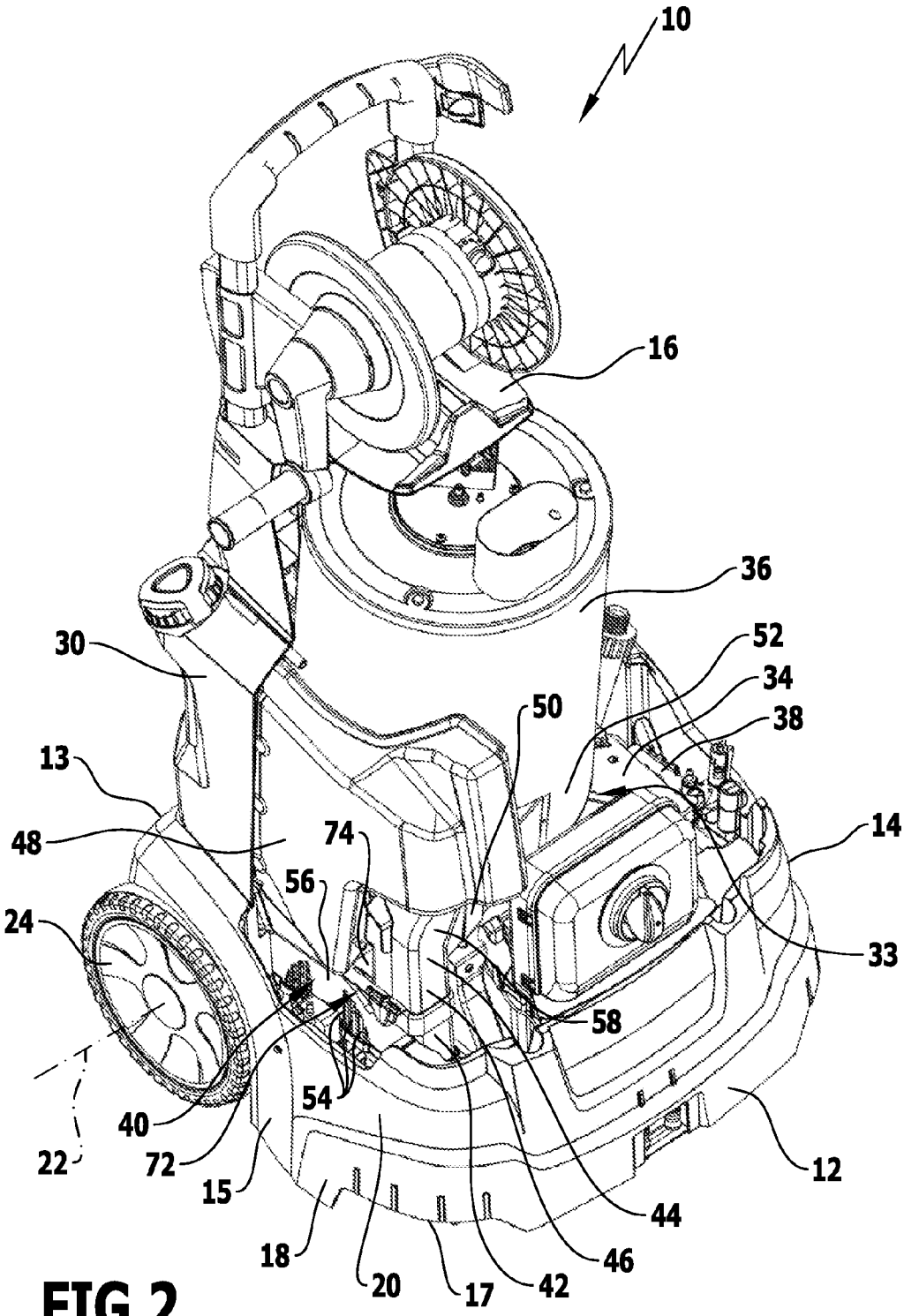
FIG. 2 shows a perspective view of the high-pressure cleaning appliance after removal of the hood.

The high-pressure cleaning appliance 10 comprises a housing 28 above the bottom part 18. The housing 28 comprises a housing wall 30 in the area of the rear side 13 and of the sections of the left side 14 and the right side 15 that face the rear side 13, and a hood 32 in the area of the front side 12 and of the sections of the left side 14 and the right side 15 that face the front side 12. The hood 32 covers an interior 33, shown uncovered in FIG. 2, of the high-pressure cleaning appliance 10.

In the interior 33, a plate-shaped support part 34 is supported on the chassis 20 above the bottom part 18. The support part 34 forms an installation surface for an upright heatable heat exchanger 36. A pump unit 38 drivable by a motor and held on the chassis 20 near the left side 14 can pressurize cleaning liquid, preferably water, supplied to the high-pressure cleaning appliance 10. This cleaning liquid can be supplied to the heat exchanger 36 through a liquid conduit, not shown in the drawings, in order to be heated up and so increase the effectiveness of the cleaning.

A blower 40 which is drivable by a motor is arranged on the chassis 20 near the right side 15. A flow of combustion air can be generated for the heat exchanger 36 by the blower 40. In order to supply combustion air to the heat exchanger 36, a flow channel 44 formed in one piece is connected to a socket-shaped connection element 42 formed by the blower 40.

A first channel section 46 of the flow channel 44 engages over the connection element 42 and, starting from the blower 40, extends in the height direction past the plate-shaped support part 34. Below a fuel container 48, arranged on the right side 15 next to the heat exchanger 36, the flow channel 44 bends approximately at a right angle and extends with a second channel section 50 above the support part 34 in the direction of the left side 14. The second channel section 50 is connected approximately tangentially to a housing shell 52 of the heat exchanger 36. Combustion air can be drawn in by the blower 40 through inlet openings 54 at a side wall 56 of the blower 40, near the right side 15.

Figure 3:
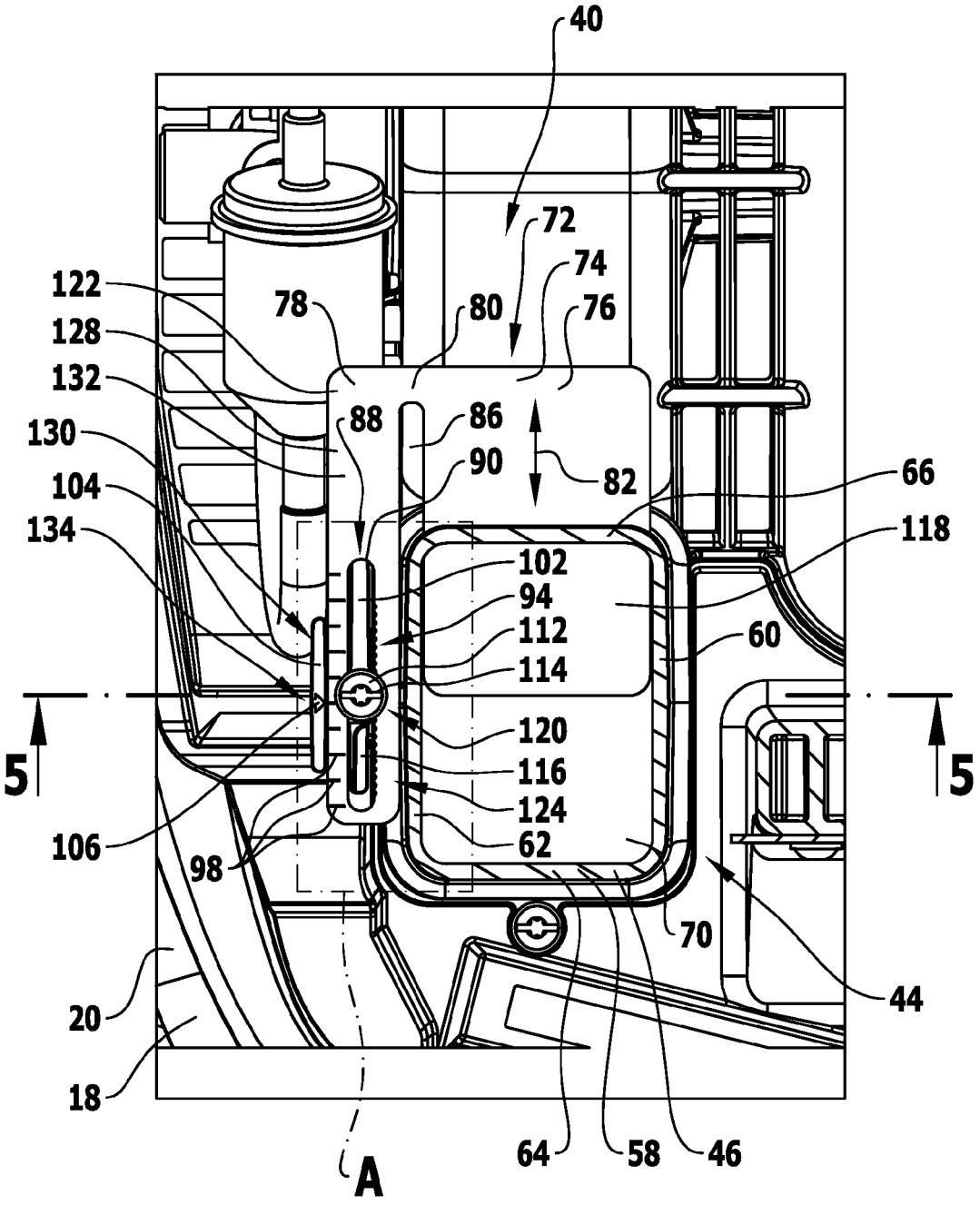
FIG. 3 shows a horizontal sectional view of part of the high-pressure cleaning appliance.
Figure 4:
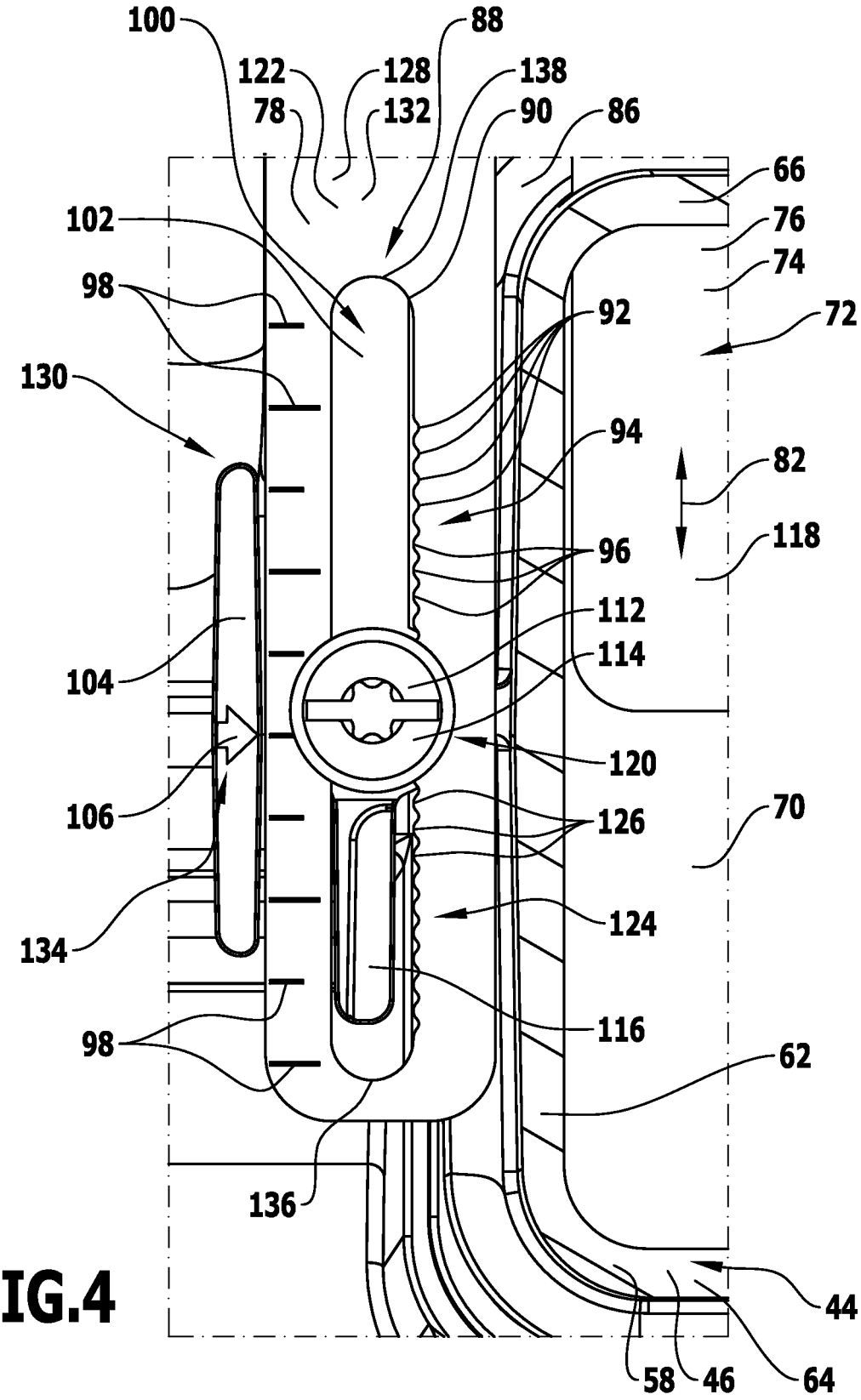
FIG. 4 shows an enlarged representation of detail A in FIG. 3.
Figure 5:
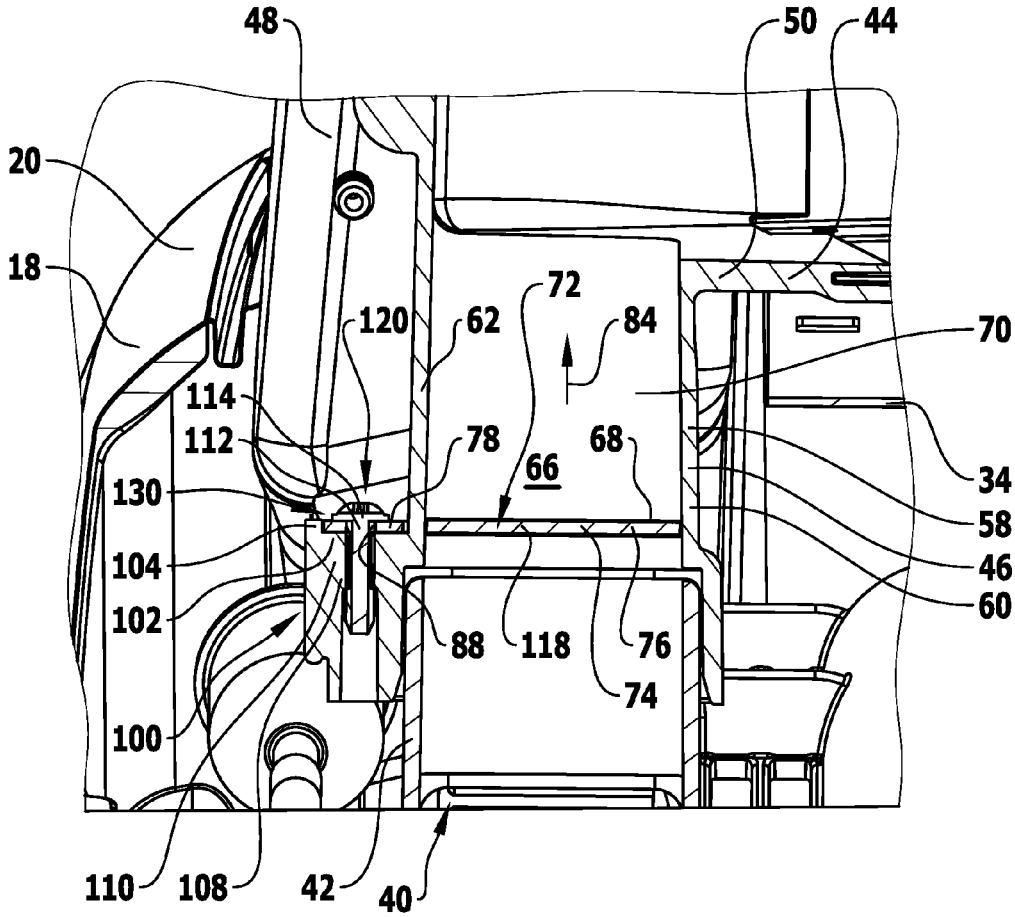
FIG. 5 shows a sectional view taken along line 5-5 in FIG. 3.

As can be seen from FIGS. 3 to 5, the flow channel 44 comprises a channel wall 58 which in the region of the first channel section 46 is approximately of rectangular cross section. The channel wall 58 comprises a left wall section 60 facing the left side 14, a right wall section 62 facing the right side 15, a front wall section 64 facing the front side 12 and a rear wall section 66 facing the rear side 13. In the rear wall section 66, a through-opening in the form of a slit 68 (FIG. 5) is formed across the width of the first channel section 46 between the wall sections 60 and 62. The channel wall 58 encloses a channel interior 70.

Typically, the total amount of combustion air which can be made available by the blower 40 is not required for operation of the heat exchanger 36. The high-pressure cleaning appliance 10 comprises a setting member 72 for setting the amount of combustion air, in relation to a time unit, actually supplied to the heat exchanger 36. It is arranged (FIGS. 3 to 5) at the flow channel 44 slightly above an upper end of the connection element 42 at the first channel section 46.

The setting member 72 is in the form of a plate 74 made of metal and in one piece, with a first plate section 76 and a second plate section 78, which are joined to each other by a web 80. The plate 74 is installed horizontally on the high-pressure cleaning appliance 10. Relative to the flow channel 44, it is configured, as will be discussed in further detail below, so as to be slidingly displaceable along a direction of displacement indicated by a double arrow 82, i.e., in the longitudinal direction of the high-pressure cleaning appliance 10, both in the direction of the front side 12 and in the direction of the rear side 13. The direction of displacement 82 is oriented perpendicularly to a direction of flow, symbolized by an arrow 84, of combustion air in the flow channel 44 in the region of the first channel section 46.

The first plate section 76 and the second plate section 78 are both of rectangular configuration and are joined to each other by the web 80 at the side of the plate 74 facing the rear side 13. Aside from that, they are separated from each other by a slit-shaped space 86. The first plate section 76 can engage in the channel interior 70 by passing through the slit 68 in the rear wall section 66. The first plate section 76 is of such dimensions that it is arranged within the first channel section 46 in a manner free of play between the wall sections 60 and 62. The first plate section 76 is also arranged in a manner free of play in the slit 68.

The plate 74 can engage around the right wall section 62 owing to the right wall section 62 engaging in the space 86, and the second plate section 78 being arranged outside of the flow channel 44, bordering on the right wall section 62. In the direction of the front side 12, the second plate section 78 extends beyond the first plate section 76, and, approximately at its center, it has an elongate hole 88 extending in the direction of displacement 82.

The elongate hole 88 has a rim 90. A plurality of identical, equidistantly spaced recesses 92 are formed in the direction of displacement 82 on the area of the rim 90 enclosing the elongate hole 88 in the direction of the right wall section 62. The recesses 92 form altogether a wave profile 94. Viewed differently, the wave profile 94 may also be regarded as being formed by identical projections 96 arranged on the rim 90. They each have contact surfaces oriented transversely to the direction of displacement 82.

A plurality of markings 98 are affixed to the second plate section 78 on its side facing the right side 15.

A supporting device 100 for the second plate section 78 is formed in one piece on the first channel section 46 on the its side facing the right side 15 in the area of transition to the connection element 42. The supporting device 100 has a first strip-shaped contact element 102 formed in the longitudinal direction of the high-pressure cleaning appliance 10, on which the second plate section 78 lies. A second strip-shaped contact element 104 of the supporting device 100 lies against the side of the second plate section 78 facing the right side 15. The second contact element 104 carries on its upper side a marking 106 in the form of an arrow.

Approximately level with the center of the first channel section 46, in relation to the longitudinal direction of the high-pressure cleaning appliance 10, the first contact element 102 forms a fixing element 108 in the form of a screw boss 110 forming a nut element. The screw boss 110 can interact with a second fixing element 112 in the form of a screw 114, which extends through the elongate hole 88 from the top to the bottom in a manner free of play and interacts with the screw boss 110 to fix the second plate section 78 to the supporting device 100 and, therefore, the plate 74 to the flow channel 44. The screw 114 also forms a guide element, in particular, a guide pin for the elongate hole 88.

The first contact element 102 is hollowed out at its side facing the front side 12, so that it has a recess 116 (FIG. 4) on its upper side facing the second plate section 78.

As mentioned above, the amount of combustion air supplied to the heat exchanger 36 can be set by the plate 74 and, in particular, the first plate section 76. Because the first plate section 76 partly engages in the channel interior 70 of the flow channel 44, it blocks part of the entire cross-sectional area enclosed by the channel wall 58 in the flow channel 44. For this reason, the free cross-sectional area of the flow channel 44 through which combustion air can pass is smaller than the entire cross-sectional area enclosed by the channel wall 58. The first plate section 76 is, therefore, also designated as channel constriction section 118.

In accordance with the amount of combustion air to be supplied to the heat exchanger 36 per time unit during operation of the high-pressure cleaning appliance 10, the plate 74 and, therefore, the channel constriction section 118 can slidingly be displaced relative to the flow channel 44 in the direction of displacement 82. To enable the plate 74 to be displaced, it will usually be necessary to first release a lock existing between the plate 74 and the flow channel 44. The plate 74 is locked at the second plate section 78 and, in particular, at the elongate hole 88 by the screw 114 interacting with the screw boss 110. The second plate section 78 forms together with the screw 114 and the screw boss 110 a locking device 120 of the high-pressure cleaning appliance 10, and the second plate section 78 is also designated as fixing section 122. The screw 114 can be released relative to the screw boss 110 with a suitable tool. Here access to the locking device 120 is made easier for the user by it being arranged outside of the flow channel 44.

After releasing the screw 114 from the screw boss 110, the plate 74 can be displaced relative to the flow channel 44. On the one hand, this can be done by, for example, a user gripping the plate 74 with his hand and moving it. On the other hand, it is, for example, possible for a user to use a user-friendly setting device 124 for displacing the plate 74. The setting device 124 comprises the projections 96 which form setting elements 126. A setting tool allocatable to the plate 74 and having a contact surface of complementary configuration to the wave profile 94 can be applied to the setting elements 126. With the high-pressure cleaning appliance 10, a tool which is also suited for releasing the screw 114, in particular, a torx screwdriver can be used in a user-friendly manner.

The tool can be passed through the elongate hole 88 from the upper side so that its bottom end engages the recess 116. By turning the tool, its contact surface can roll on the wave profile 94. The setting elements 126 thereby form with the tool a linear drive for the plate 74. The plate 74 can thus be displaced in the direction of the front side 12 or the rear side 13 by continued turning of the tool. Because the setting elements 126 are arranged on the second plate section 78, the latter is also designated as setting section 128.

When the plate 74 is being displaced relative to the flow channel 44, it is guided by a guide device 130. This comprises the second plate section 78, for this reason also designated as guide section 132, the contact elements 102 and 104, the screw 114, the wall sections 60 and 62 and the slit 68.

When the plate 74 is displaced in the direction of the front side 12, the free cross-sectional area of the flow channel 44 is, consequently, reduced, and a smaller amount of combustion air is supplied to the heat exchanger 36. When the plate 74 is displaced in the direction of the rear side 13, the free cross-sectional area of the flow channel 44 is enlarged, and the amount of combustion air supplied to the heat exchanger 36 is increased. The configuration of the setting member 72 as displaceable plate 74 is advantageous over the setting members of conventional high-pressure cleaning appliances because owing to the sliding displacement of the plate 74 and in particular, the channel constriction section 118, relative to the flow channel 44, the change in the free cross-sectional area is linearly dependent upon the path of displacement of the plate 74 relative to the flow channel 44.

This is not the case with conventional high-pressure cleaning appliances in which the setting member has a flap pivotable relative to the flow channel. In an implementation of the high-pressure cleaning appliance 10, this linear dependence of the change in the free cross-sectional area on the path of displacement of the plate 74 has proven advantageous for precisely setting the change in the amount and, therefore, the total amount of combustion air supplied to the heat exchanger 36.

In particular, a stepless change in the free cross-sectional area is made possible with the high-pressure cleaning appliance 10, because the plate 74 and, therefore, the channel constriction section 118 are steplessly displaceable relative to the flow channel 44.

The markings 98 on the second plate section 78 and the marking 106 on the second contact element 104 interact to form a display device 134 by means of which the position of the plate 74 and, therefore, of the channel constriction section 118 relative to the flow channel 44 is displayable. The free cross-sectional area of the flow channel 44 can also be determined from this display.

When the plate 74 assumes the desired position relative to the flow channel 44, i.e., the free cross-sectional area of the flow channel 44 is set by the channel constriction section 118 such that the desired amount of combustion air is supplied to the heat exchanger 36, a user can fix the plate 74 again by means of the locking device 120.

The rim 90 of the elongate hole 88 forms at its end facing the front side 12 a first stop element 136, and at its end facing the rear side 13 a second stop element 138. The path of displacement of the plate 74 relative to the flow channel 44 can be delimited by the stop elements 136 and 138, which can come to lie against the screw 114.

When the second stop element 138 is lying against the screw 114, the flow channel 44 is not completely blocked by the channel constriction section 118.

In this way, it is ensured that a minimum amount of combustion air will in any case be supplied to the heat exchanger 36. When the first stop element 136 is lying against the screw 114, the channel constriction section 118 still remains partly positioned within the channel interior 70. It is thereby ensured that the channel constriction section 118, when being displaced relative to the flow channel 44, will not be inadvertently passed through the slit 68. In this way, an otherwise necessary re-inserting of the channel constriction section 118 into the slit 68 can be avoided.

The invention claimed is:

1. High-pressure cleaning appliance, comprising:

a heatable heat exchanger for heating up a liquid dispensable by the high-pressure cleaning appliance, a blower with a flow channel connected thereto for supplying combustion air to the heat exchanger, and a setting member for setting an amount of combustion air suppliable to the heat exchanger, the setting member having a channel constriction section which is positionable in the flow channel and movable relative thereto for changing a free cross-sectional area of the flow channel, the channel constriction section being configured so as to be slidingly displaceable relative to the flow channel, a locking device for releasably locking the channel constriction section relative to the flow channel, a setting device for enabling displacement of the channel constriction section when the locking device is in a release position, the setting device comprising a setting section coupled to the channel constriction section, the setting section comprising a plurality of setting elements, the plurality of setting elements each having a contact surface oriented transversely to a direction of displacement of the channel constriction section and being spaced from one another along the direction of displacement of the channel constriction section, and the setting section being located outside of the flow channel.

2. High-pressure cleaning appliance in accordance with claim 1, wherein the channel constriction section is displaceable transversely to a direction of flow of the combustion air in the flow channel.

3. High-pressure cleaning appliance in accordance with claim 1, wherein the channel constriction section is displaceable in a stepless manner relative to the flow channel.

4. High-pressure cleaning appliance in accordance with claim 1, wherein the channel constriction section is free of play in at least one direction oriented transversely to the direction of displacement of the channel constriction section.

5. High-pressure cleaning appliance in accordance with claim 1, further comprising at least one stop element for delimiting a path of displacement of the channel constriction section.

6. High-pressure cleaning appliance in accordance with claim 1, further comprising a guide device for guiding the channel constriction section relative to the flow channel.

7. High-pressure cleaning appliance in accordance with claim 6, wherein the guide device comprises at least one contact element against which the setting member is positionable, during the displacement, with a guide section coupled to the channel constriction section.

8. High-pressure cleaning appliance in accordance with claim 6, wherein the guide device comprises an elongate hole extending along the direction of displacement of the channel constriction section and a guide element engaging the elongate hole.

9. High-pressure cleaning appliance in accordance with claim 8, wherein the setting member comprises a guide section coupled to the channel constriction section, the guide section comprising the elongate hole.

10. High-pressure cleaning appliance in accordance with claim 6, wherein the guide device is connected to the flow channel.

11. High-pressure cleaning appliance in accordance with claim 1, wherein the locking device is configured as a clamping device.

12. High-pressure cleaning appliance in accordance with claim 1, wherein the locking device comprises an elongate hole extending along the direction of displacement of the channel constriction section, a first fixing element passing through the elongate hole, and a second fixing element which interacts with the first fixing element to fix the elongate hole relative to the first and second fixing elements.

13. High-pressure cleaning appliance in accordance with claim 12, wherein the setting member comprises a fixing section which includes the elongate hole and is coupled to the channel constriction section.

14. High-pressure cleaning appliance in accordance with claim 1, wherein the locking device is connected to the flow channel.

15. High-pressure cleaning appliance in accordance with claim 1, wherein the locking device is arranged outside of the flow channel.

16. High-pressure cleaning appliance in accordance with claim 1, wherein the plurality of setting elements form together with a setting tool allocatable to the setting member a linear drive.

17. High-pressure cleaning appliance in accordance with claim 1, wherein the setting section comprises an elongate hole, on one of the rims of which the plurality of setting elements are arranged.

18. High-pressure cleaning appliance in accordance with claim 1, wherein the high-pressure cleaning appliance comprises a display device for displaying a position of the channel constriction section relative to the flow channel.

19. High-pressure cleaning appliance in accordance with claim 1, wherein the setting member is at least partially of a plate-shaped configuration.

20. High-pressure cleaning appliance in accordance with claim 19, wherein the channel constriction section is of a plate-shaped configuration.

21. High-pressure cleaning appliance in accordance with claim 19, wherein the setting member comprises at least one of a plate-shaped guide section for guiding the channel constriction section, a plate-shaped fixing section for releasably locking the channel constriction section, and a plate-shaped setting section for displacing the channel constriction section.

22. High-pressure cleaning appliance in accordance with claim 1, wherein the setting member is of a one-piece configuration.

23. High-pressure cleaning appliance in accordance with claim 1, wherein the setting member is made of metal.

24. High-pressure cleaning appliance in accordance with claim 1, wherein the channel constriction section passes through a through-opening formed in a wall of the flow channel.

25. High-pressure cleaning appliance in accordance with claim 24, wherein the through-opening is of a slit-shaped configuration.

* * * * *